US009196398B2

(12) United States Patent
Kroushl et al.

(10) Patent No.: US 9,196,398 B2
(45) Date of Patent: Nov. 24, 2015

(54) DISCONTINUOUS SHIELDING TAPES FOR DATA COMMUNICATIONS CABLE

(71) Applicant: NEXANS, Paris (FR)

(72) Inventors: Paul Kroushl, Lancaster, PA (US); Qibo Jiang, Ephrata, PA (US); Greg Heffner, Ephrata, PA (US); Joshua Keller, Mechanicsburg, PA (US)

(73) Assignee: NEXANS, Paris (FR)

( * ) Notice: Subject to any disclaimer, the term of this patent is extended or adjusted under 35 U.S.C. 154(b) by 162 days.

(21) Appl. No.: 13/779,089

(22) Filed: Feb. 27, 2013

(65) Prior Publication Data

US 2014/0238720 A1 Aug. 28, 2014

(51) Int. Cl.

| | |
|---|---|
| ***H01B 7/00*** | (2006.01) |
| ***H01B 11/04*** | (2006.01) |
| ***H01B 11/10*** | (2006.01) |

(52) U.S. Cl.

CPC ..... *H01B 11/04* (2013.01); *H01B 11/1008* (2013.01)

(58) Field of Classification Search

CPC ..... H01B 5/00; H01B 5/14; H01B 7/00; H01B 7/02; H01B 7/0208; H01B 7/0216; H01B 7/17; H01B 7/18; H01B 7/183–7/189; H01B 7/22–7/28; H01B 11/00; H01B 11/002; H01B 11/005; H01B 11/02; H01B 11/04; H01B 11/06–11/12

USPC ..... 174/36, 102 R, 102 SP, 103, 108, 109, 174/110 R, 110 SP, 113 R, 113 C, 114 R, 174/114 S, 115, 116 R

See application file for complete search history.

(56) References Cited

U.S. PATENT DOCUMENTS

| | | | | |
|---|---|---|---|---|
| 6,207,266 | B1 * | 3/2001 | Kanbara et al. | 428/323 |
| RE42,266 | E * | 4/2011 | Sparrowhawk | 174/102 R |
| 7,923,641 | B2 * | 4/2011 | Smith et al. | 174/113 R |
| 8,119,906 | B1 * | 2/2012 | Smith et al. | 174/36 |
| 8,119,907 | B1 * | 2/2012 | McNutt | 174/36 |
| 8,183,462 | B2 * | 5/2012 | Nordin et al. | 174/102 R |
| 8,217,267 | B2 * | 7/2012 | Nordin et al. | 174/102 R |
| 2006/0048961 | A1 * | 3/2006 | Pfeiler et al. | 174/36 |
| 2009/0020712 | A1 * | 1/2009 | Matsumoto | 250/515.1 |
| 2009/0223694 | A1 * | 9/2009 | Nordin et al. | 174/34 |
| 2010/0224389 | A1 | 9/2010 | Jenner et al. | |

FOREIGN PATENT DOCUMENTS

| | | |
|---|---|---|
| GB | 2432963 | 6/2007 |

OTHER PUBLICATIONS

European Search Report dated 2013.

* cited by examiner

*Primary Examiner* — William H Mayo, III
(74) *Attorney, Agent, or Firm* — Sofer & Haroun, LLP

(57) ABSTRACT

The present arrangement provides a communication cable having a plurality of twisted pair communication elements, a jacket surrounding the twisted pairs and a shield element disposed between the pairs and the jacket. The shield element is constructed as a tape substrate with a plurality of foil shielding elements disposed thereon, the foil shielding elements being formed in the shape of triangles and arranged on the substrate with at least a first foil shield element having a base of its triangle shape disposed substantially parallel to a longitudinal edge of the tape substrate. Each subsequent triangle is disposed on the tape substrate at a distance apart from the first triangle foil shielding element with a base of its triangle shape disposed substantially parallel to an opposite longitudinal edge of the tape substrate.

10 Claims, 11 Drawing Sheets

DISCONTINUOUS SHIELDING TAPES FOR DATA COMMUNICATIONS CABLE

BACKGROUND

1. Field of the Invention

This application relates to a shielding tape. More particularly, this application relates to a shielding tape for LAN (Local Area Network) cables.

2. Description of the Related Art

LAN or network type communication cables are typically constructed of a plurality of twisted pairs (two twisted conductors), enclosed within a jacket. A typical construction is to have four twisted pairs inside of a jacket, but many other larger pair count cables are available.

Care is taken to construct these cables in a manner to prevent cross talk with adjacent cables. For example, in a typical installation, many LAN cables may be arranged next to one another, and signals in the pairs from a first cable may cause interference or crosstalk with another pair in an adjacent LAN cable. In order to prevent this, the lay length or twist rate of the pairs in a cable are varied differently from one another. Additionally, when pairs in adjacent cables are running parallel to one another the cross talk can be increased so the pairs within a cable are twisted around one another (helically or SZ stranding) to further decrease interference. Spacing elements can also be used so that the jacket is spaced apart from the pairs so that pairs in adjacent cables are as far away as possible.

Nevertheless, despite all of these features, in some cases, the requirements for increased bandwidth may necessitate additional protection from crosstalk. One such common type of protection is shielding. LAN cable shielding is usually in the form of a foil that is wrapped around the pairs inside the cable, under the jacket. This metal foil is usually wrapped around the assembled core of twisted pairs prior to jacketing and is constructed of suitable metals, for example aluminum.

Although the shield is effective for preventing alien crosstalk and other external signal interferences, the shield must be grounded to the connector in order to meet safety regulations. This is a time consuming step that increases the cost to install the shielded cable. One typical example requires a drain wire to be helically coiled around the shield which also increases the overall cable cost.

In the prior art, there have been proposals to mitigate the above effect by providing a discontinuous shielding tape having periodic breaks in the shield. This design makes sure that any signals that collect in the shield do not extend continuously from end to end of the cable and this obviates the need for grounding the shield. However, in doing so, this design has generated yet another drawback, particularly with respect to the signal quality within the pairs of the cable, owing to interference caused by signals generated by the discontinuous shield elements.

For example, with discontinuous shields, the signals traveling in the pairs can cause induced signals in discontinuous foil elements with the breaks in the shielding giving rise to reflected waves which can create issues with return loss. The patches can collectively interact with the transmitting electrical signals in a cumulative or resonant manner to produce a spike in return loss at a particular frequency of the transmitting signals.

In one example, where the foil size and shape is rectangular with each foil element of the same size and at regular spacing from one another, the generated reflected waves are such that they may occur at one specific frequency, and at a significant amplitude.

Other prior art arrangements of discontinuous shields have attempted to minimize the reflected wave that can be created by discontinuous shielding elements of equal length and spacing by varying the length of the shielding elements relative to the length of the foil segments, finding that the frequency/location of the spike may depend upon the sizes of the foil sections and the gap therebetween.

Other prior art discontinuous shielding tapes try to minimize the amplitude of the reflected wave by having foil pieces (and breaks) that are not perpendicular to the long edge of the substrate running in the direction of the pairs (ie parallelograms).

Although these various arrangements may have some mitigating effect to reduce the amplitude of the reflected waves by increasing the range of frequencies that these reflections occur at, they are still not an optimum solution.

OBJECTS AND SUMMARY

The present arrangement overcomes the drawbacks of the prior art by providing a discontinuous shielding tape, where the conductive shielding elements, disposed on the tape substrate do not form a complete electrical connection from one end of the cable to the other. Moreover, the metal shielding elements on the tape substrate are shaped and dimensioned in a manner that is easy to construct, but also minimizes other signal/interference problems that may be caused by such discontinuous shielding elements, reducing the amplitude of the reflected waves by further increasing the range of frequencies that these reflections occur at and reducing the amplitude of such interference signals.

To this end, the present arrangement provides a communication cable having a plurality of twisted pair communication elements, a jacket surrounding the twisted pairs and a shield element disposed between the pairs and the jacket.

The shield element is constructed as a tape substrate with a plurality of foil shielding elements disposed thereon, the foil shielding elements being formed in the shape of triangles and arranged on the substrate with at least a first foil shield element having a base of its triangle shape disposed substantially parallel to a longitudinal edge of the tape substrate. Each subsequent triangle is disposed on the tape substrate at a distance apart from the first triangle foil shielding element with a base of its triangle shape disposed substantially parallel to an opposite longitudinal edge of the tape substrate.

BRIEF DESCRIPTION OF THE DRAWINGS

The present invention can be best understood through the following description and accompanying drawings, wherein.

DETAILED DESCRIPTION

Figure 1:
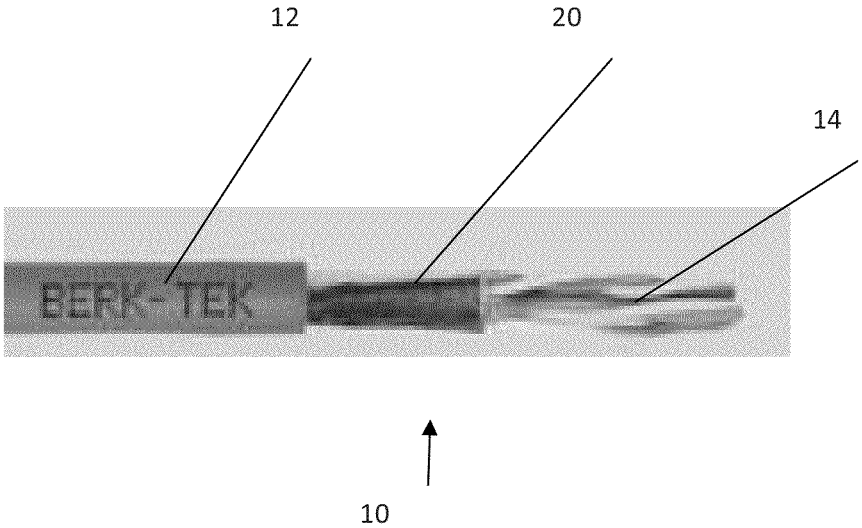
FIG. 1 shows an exemplary four pair LAN cable with a shield showing the general application of the shield, in accordance with one embodiment.

In one embodiment, FIG. 1 shows an exemplary LAN cable 10 having a jacket 12, a plurality of twisted pairs 14 and a discontinuous shield 20, disposed over pairs 14 within jacket 12. For the purpose of illustrating the salient features of the present arrangement, different versions of discontinuous shielding tape 20, shown in FIGS. 2-9, is envisioned as being applied as shown by element 20 in FIG. 1. However, it is understood that the subsequently described discontinuous shields 20, shown in FIGS. 2-9 may be equally applied to larger or smaller pair count cables, or in other communication cable designs that employ a shield.

Figure 2:
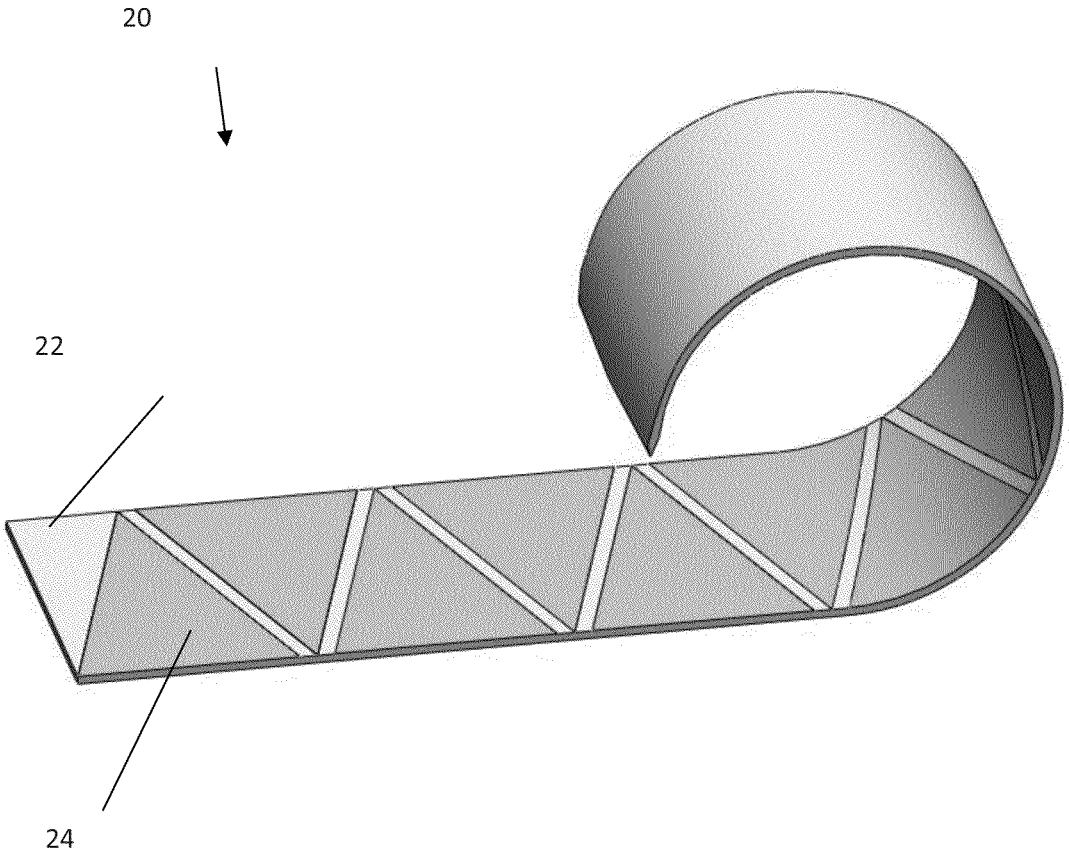
FIG. 2 shows a discontinuous shield in accordance with one embodiment.

Turning to the discontinuous shielding tape 20, FIG. 2, shows a first discontinuous shielding tape 20 constructed of a first substrate 22 and a plurality of triangular shaped foil elements 24. In another arrangement, as shown in FIG. 3, triangle shaped foil elements 24 are disposed on both sides of substrate 22.

In a preferred embodiment substrate 22 is typically a thin plastic film composed of any one of polyethylene terephthalate (Mylar™), polypropylene, cellulose acetate butyrate, or other film with sufficient physical properties to survive typical cabling processes. These tapes typically range from 0.001" to 0.005" in thickness and are sometimes flame retarded to improve cable fire test performance. The width of substrate 22 can vary depending on the size of the cable construction being shielded and the method of shield application. Exemplary widths for substrate 22 can range from 0.250" to 3.000".

Regarding the composition of the triangular shaped foil elements 24, such elements can have a wide variety of dimensions depending on the width of substrate 22 and the angles used to form the triangles. Typically the thickness of foil 24 can range anywhere from 0.0005" to 0.0050" depending on the type of external shielding effectiveness required. For the arrangement with foil 24 on only one side of substrate 22, foil 24 typically faces away from pairs 14 with the non-conductive substrate 22 being in contact with pairs 14. Alternatively, there may be some situations where foil elements 24 on substrate 22 are applied to face towards twisted pairs 14 with foil 24 either being in direct contact with pairs 14 or separated from the pairs 14 by another layer, such as a second layer of non-conductive substrate.

In one exemplary arrangement, substrate 22 is substantially 1" wide with a thickness of about 0.0015" and constructed of polyethylene terephthalate. The preferred triangular metal foil elements 24 in this configuration have a base of substantially 2", a height of 1", 45 degree angles at the base and a 90 degree angle at the vertex. The bases of triangular foil elements 24 are located along the opposite sides of substrate 22 in such a manner where the base of each successive foil triangle element 24 is located on the opposite side of substrate 22 as shown for example in FIGS. 2 and 3. A preferred gap distance between any two triangles 22 is substantially 0.040" or less.

Unlike the prior art discussed above, the present arrangement, using triangular foil elements 24, applied in alternating fashion, creates reflected waves throughout the entire frequency spectrum instead at just isolated frequencies. By doing this, the amplitude of the reflected waves are greatly reduced along the length of cable 10, thus improving the overall performance of the discontinuously shielded cable.

Figure 3A:
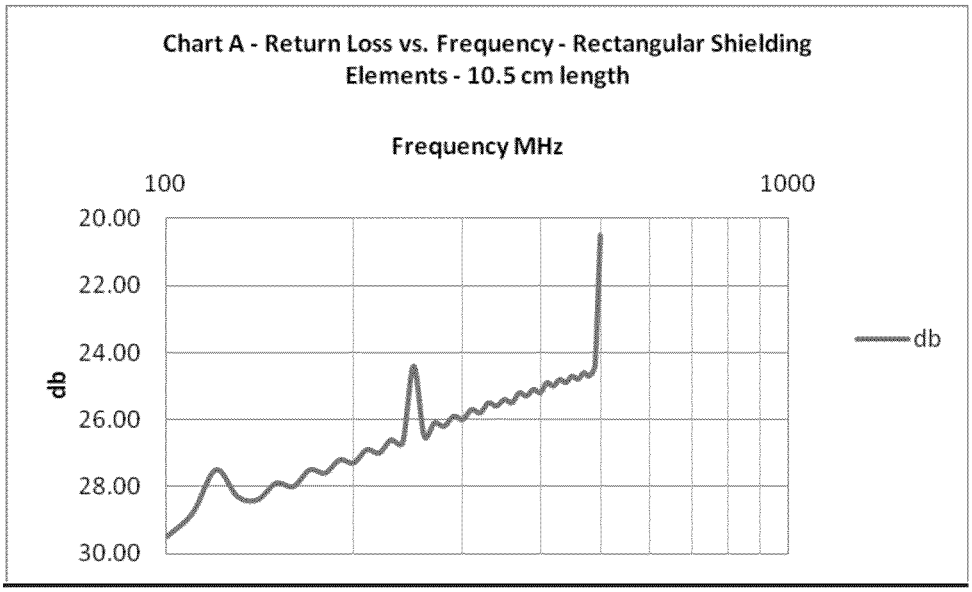
Figure 3A PRIOR ART
FIGS. 3A and 3B are charts showing insertion loss in the prior art (FIG. 3A vs. the present arrangement FIG. 3B, in accordance with one embodiment.

FIG. 3A is prior art chart showing insertion loss peaks over certain common communication cable frequencies using prior art rectangular shield elements (10.5 cm) showing a large insertion loss spike at 500 MHz and smaller spikes at 250 MHz and 125 MHz. This phenomenon is not desirable.

Figure 3B:
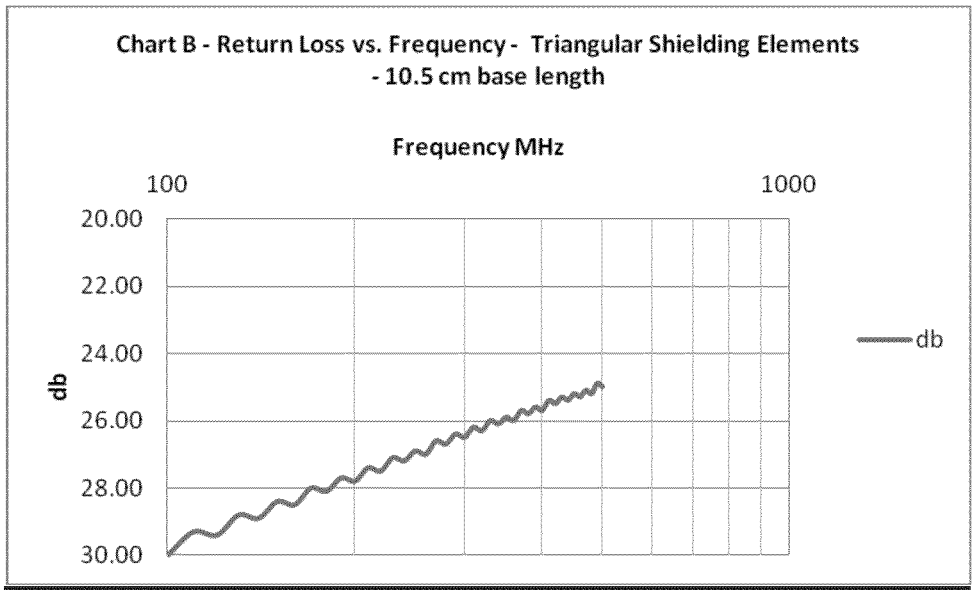

FIG. 3B is another chart showing insertion loss peaks over the same common communication cable frequencies using the present arrangement as shown in FIG. 2, using triangular shield elements (base length 10.5 cm). Since triangle elements 24 do not provide a distinct/regular surface perpendicular to the travel of the signals in pairs 14, there are no discrete frequencies of reflected waves and thus no corresponding return loss spikes as in the prior art arrangements.

Figure 4:
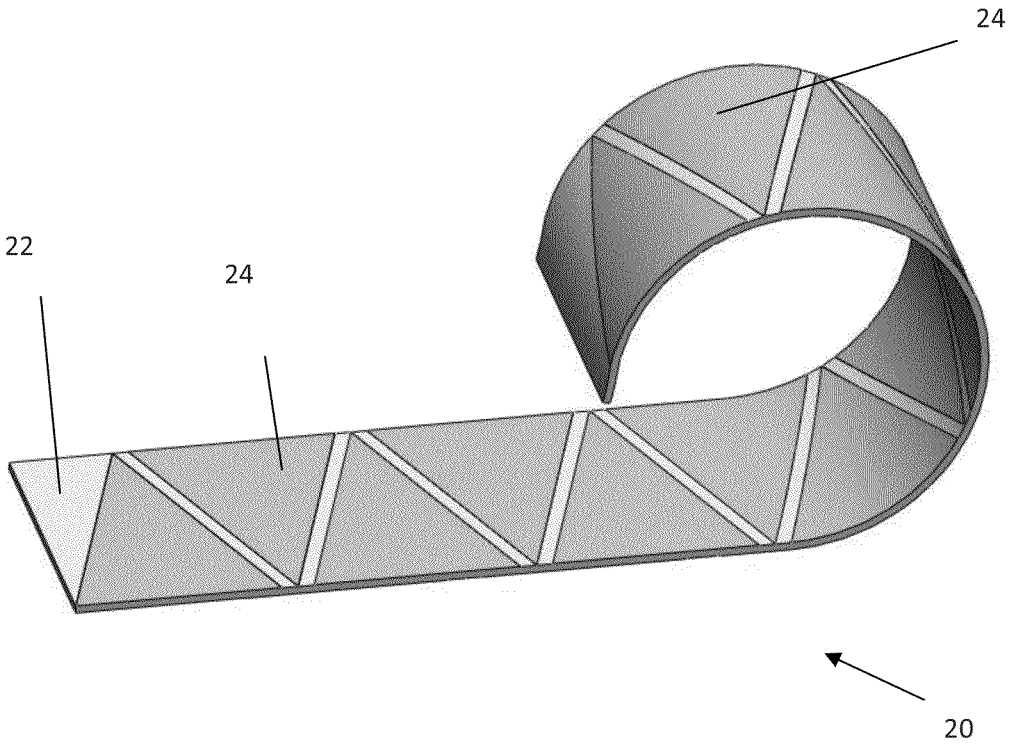
FIG. 4 shows a discontinuous shield in accordance with one embodiment.

Regarding the version of tape 20 shown in FIG. 4, the advantage to disposing triangle shaped foil elements 24 on both sides of substrate 22 is that greater shielding effectiveness can be obtained. When substrate 22 has a discontinuous shield foil 24 on only one side, gaps exist in which noise can enter cable 10 or signal can escape from cable 10. When both sides of substrate 22 have discontinuous shield elements 24, elements 24 are arranged in such a way where they overlap one another and along with the gaps on each side respectively, providing a more complete shielding if required.

Figure 5:
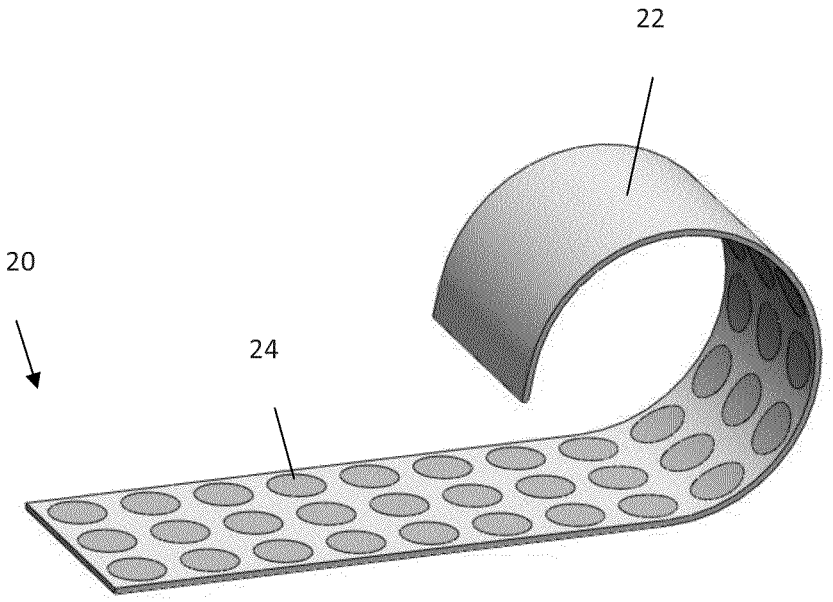
FIG. 5 shows a discontinuous shield in accordance with one embodiment.
Figure 6:
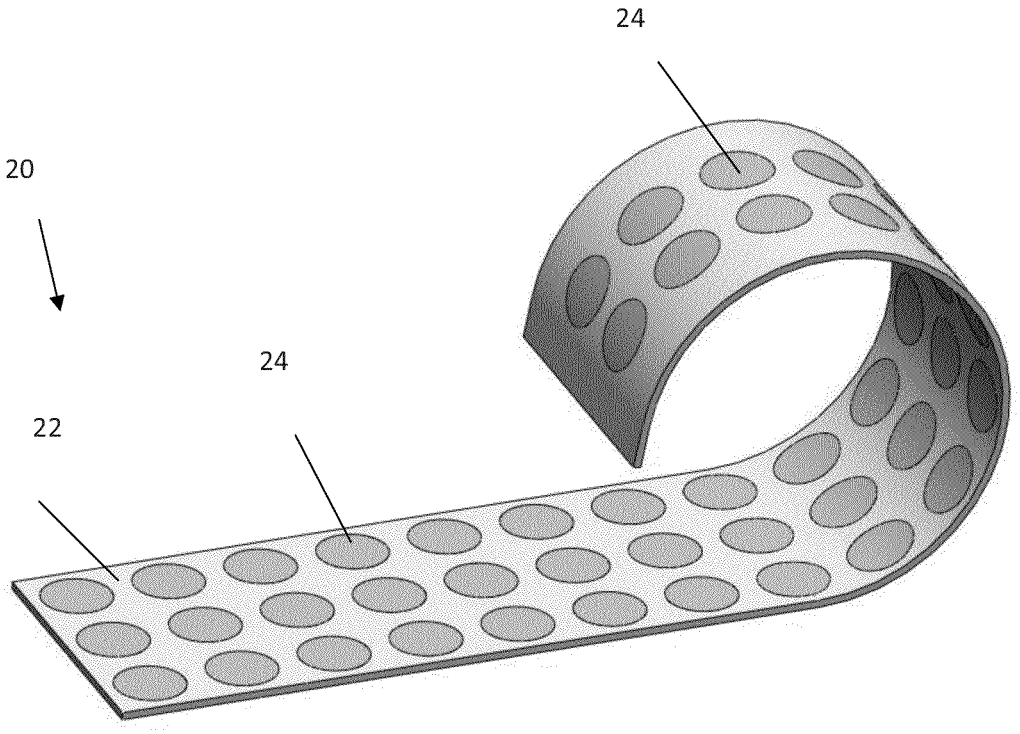
FIG. 6 shows a discontinuous shield in accordance with one embodiment.
Figure 7:
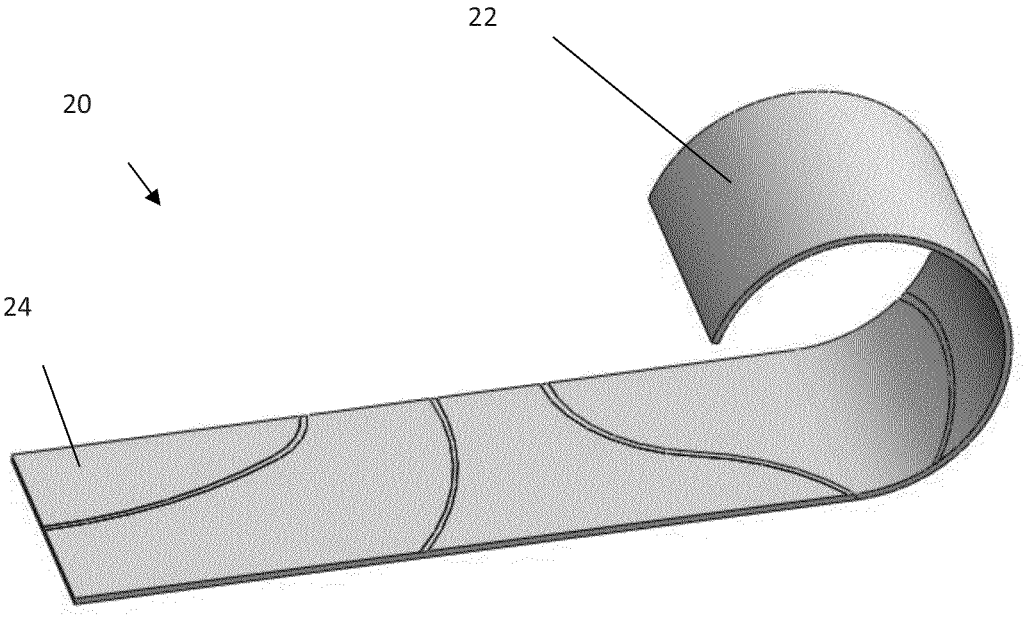
FIG. 7 shows a discontinuous shield in accordance with one embodiment.
Figure 8:
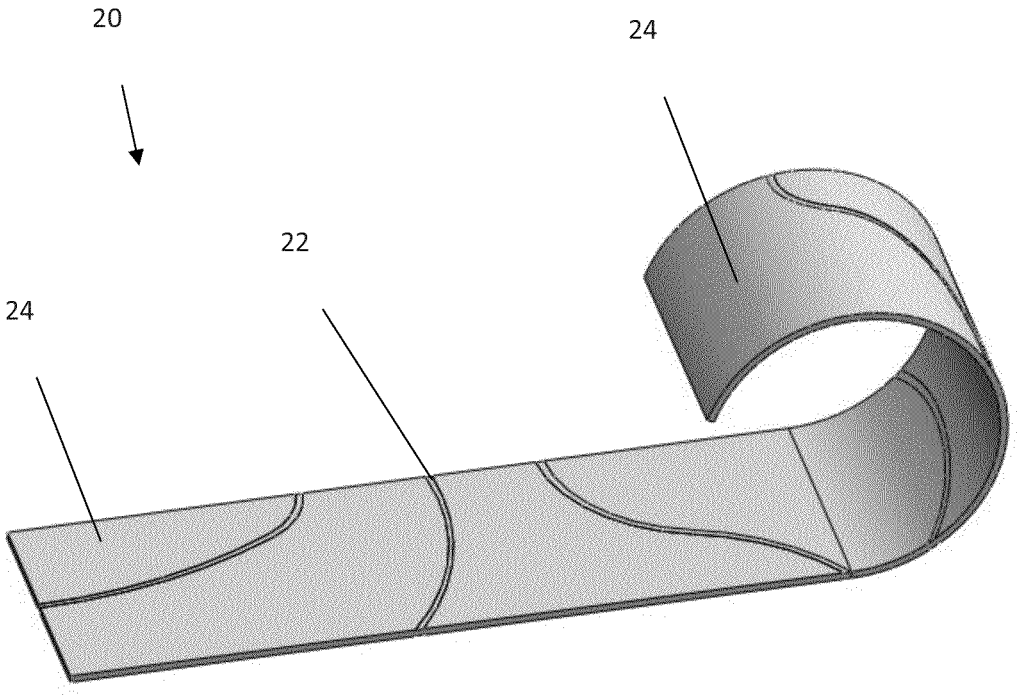
FIG. 8 shows a discontinuous shield in accordance with one embodiment.

In another arrangement, as shown in FIGS. 5 and 6, instead of using triangle shaped foil elements 24, foil elements 24 are circular shaped. And, in another arrangement, as shown in FIGS. 7 and 8, instead of using triangle shaped foil elements 24, foil elements 24 are irregularly shaped.

Circular shaped and irregularly shaped foil elements 24, as with triangles, also mitigate the standing wave issue. In one example, circles 24 have a diameter of about substantially $1/10^{th}$ the width of substrate 22 and placed in succession across the width of substrate 22 with a thickness ranging from about 0.0005" to 0.0050", although the invention is not limited in this respect. In one arrangement, shielding effectiveness is improved by placing smaller shielding circles or other shielding foil shapes in the small interstices between the circular shielding elements 24.

Figure 9:
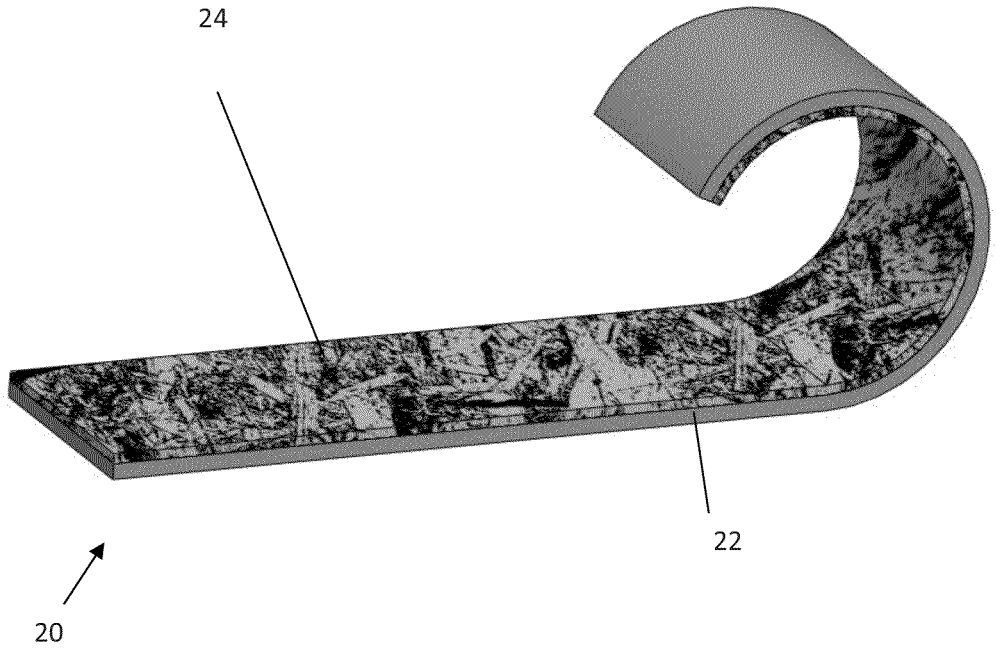
FIG. 9 shows a discontinuous shield in accordance with one embodiment.
Figure 10:
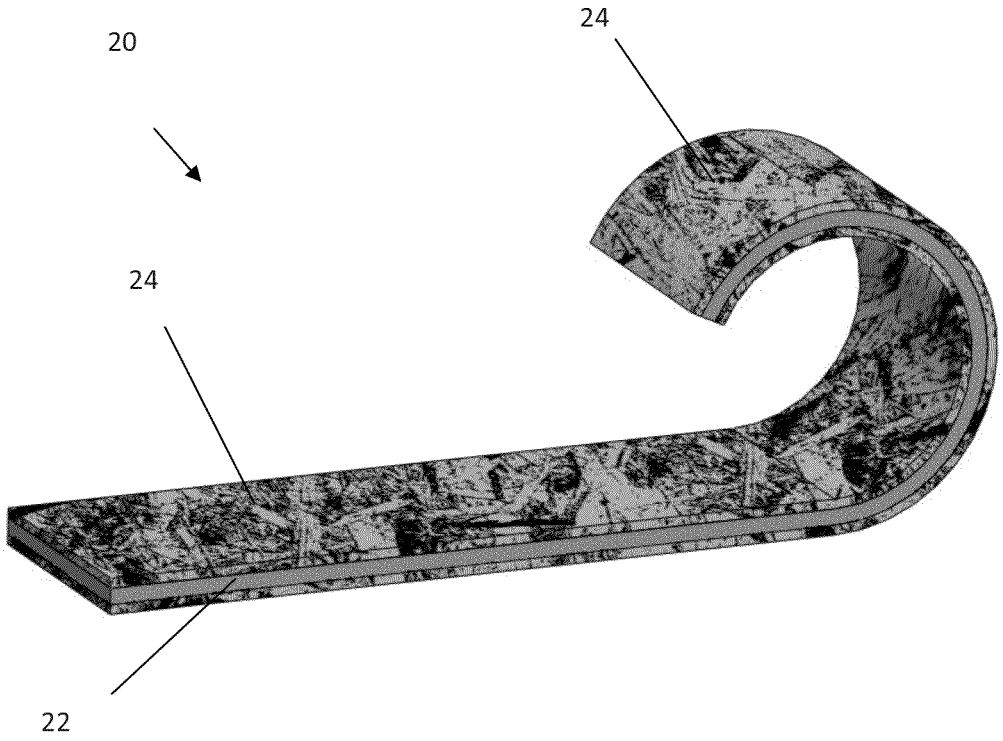
FIG. 10 shows a discontinuous shield in accordance with one embodiment.

In yet another arrangement, as shown in FIGS. 9 and 10, instead of using triangle shaped foil 24, foil elements 24 are initially formed as a continuous element, but are later randomly disrupted into a broken arrangement. In this arrangement, the shielding 24 is chipped by mechanical means and blown onto a glue 25, coated onto substrate 22 in random locations on substrate 22. The chips on shielding material 24 may vary in shape and size according to the speed and design of the mechanical chipper. In one arrangement, overlapping shielding material can be wiped off or blow off by means of brushes or air jets. In such an arrangement, it may be desirable to press the shielding material on to substrate 22 by means of a roller or other device for proper adhesion. The excess shielding material can be cut from the edges of substrate 22 by means of a cutter on each side. Shielding material should lay on substrate 22 in many different orientations; having some disjointed sections placed randomly along the length of substrate 22. Aluminum foil sheet is placed over a heated metal form of the desired shape with small holes in the surface. These small holes would lead to an internal cavity that is under vacuum. The vacuum would hold the aluminum foil over the form while a die slightly larger but the same shape as the form comes down over the form cutting the aluminum foil sheet. What is now left is a piece of aluminum foil in the shape of the form being held in place by the small holes in the form drawing vacuum. The heated form with the aluminum foil piece adhered to it is then positioned over a substrate with a heat activated adhesive such as a hot melt glue. The heated form with the aluminum foil piece is then positioned over and pressed down onto the substrate. The form is then momentarily held in place so that heat from the form can be transferred to the heat activated adhesive. Once the heat activated adhesive forms a bond to the aluminum foil piece, the form can be lifted away from the substrate, leaving the aluminum foil piece bonded to the substrate. A continuous process can be created with this technique by using multiple forms. A system to adhere the aluminum foil pieces to the substrate can be based on adhesives that are not heat activated as well. While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A communication cable, said cable comprising:

a plurality of twisted pair communication elements;

a jacket surround said twisted pairs; and a shield element disposed between said pairs and said jacket, wherein said shield element is constructed as a solid tape substrate with a plurality of foil shielding elements disposed thereon, the foil shielding elements being formed in the shape of triangles and arranged on said substrate with at least a first foil shield element having a base of its triangle shape disposed substantially parallel to a longitudinal edge of said tape substrate with each subsequent triangles disposed on said tape substrate at a distance apart from said first triangle foil shielding element with a base of its triangle shape disposed substantially parallel to an opposite longitudinal edge of said tape substrate.

2. The communication cable as claimed in claim 1, wherein tape substrate is constructed of a material selected from the group consisting of polyethylene terephthalate, polypropylene, and cellulose acetate butyrate.

3. The communication cable as claimed in claim 1, wherein said tape substrate is substantially 0.001" to 0.005" in thickness.

4. The communication cable as claimed in claim 1, wherein tape substrate is substantially 0.250" to 3.000" in width.

5. The communication cable as claimed in claim 1, wherein said foil shielding elements are substantially 0.0005" to 0.0050" in thickness.

6. The communication cable as claimed in claim 1, wherein said substrate is substantially 1" wide, has a thickness of substantially 0.0015" thick and constructed of polyethylene terephthalate with said triangular metal foil elements each having a base of substantially 2" wide, a height of substantially 1" across the width of said substrate with 45 degree angles at the base and a 90 degree angle at the vertex.

7. The communication cable as claimed in claim 1, wherein a gap between any two triangular metal foil elements is substantially 0.040" or less.

8. The communication cable as claimed in claim 1, wherein said foil shielding elements are disposed on both sides of said substrate.

9. The communication cable as claimed in claim 1, wherein said foil shielding elements and gaps therebetween are arranged on said substrate such that communications signals passing through said twisted pairs, reflecting off of said foil shielding elements generated standing waves, where such standing waves are distributed over wide range of frequencies.

10. The communication cable as claimed in claim 1, wherein said foil shielding elements are disposed on a side of said substrate facing inwards towards said twisted pairs of said cable.

* * * * *